United States Patent [19]

Profera, Jr. et al.

[11] Patent Number: 4,471,361

[45] Date of Patent: Sep. 11, 1984

[54] PHASE RECONFIGURABLE BEAM ANTENNA SYSTEM

[75] Inventors: Charles E. Profera, Jr., Cherry Hill; Hendrick H. Soule, Jr., Interlaken, both of N.J.

[73] Assignee: RCA Corporation, New York, N.Y.

[21] Appl. No.: 422,463

[22] Filed: Sep. 23, 1982

[51] Int. Cl.[3] ..... H01Q 21/08; H01P 5/18

[52] U.S. Cl. ..... 343/853; 333/109

[58] Field of Search ..... 333/109; 343/368, 371, 343/372, 374

[56] References Cited

U.S. PATENT DOCUMENTS 3,988,705 10/1976 Drapac ..... 333/109

4,223,283 9/1980 Chan ..... 333/109

*Primary Examiner*—Ali Lieberman

*Attorney, Agent, or Firm*—Joseph S. Tripoli; Robert L. Troike

[57] ABSTRACT

A reconfigurable shaped beam antenna system includes dual mode power divider with the output ports coupled to an equal number of radiators arranged in a row to provide a linear phase progression. One of the output ports of the power divider is selectively coupled to an additional radiator located at the opposite end of the row via 180° phase shifter to maintain the phase progression.

5 Claims, 8 Drawing Figures

| OUTPUT PORT | AMPLITUDE | RELATIVE PHASE OF OUTPUT SIGNAL IN RESPONSE TO SIGNAL APPLIED ONLY TO INPUT PORT 1 | RELATIVE PHASE OF OUTPUT SIGNAL IN RESPONSE TO SIGNAL APPLIED ONLY TO INPUT PORT 2 |
|---|---|---|---|
| 1 | 1.0 | 22.5° | −22.5° |
| 2 | 1.0 | 67.5° | −67.5° |
| 3 | 1.0 | 112.5° | −112.5° |
| 4 | 1.0 | 157.5° | −157.5° |

| OUTPUT PORT BEAMS | AMPLITUDE | | DUAL MODE PHASES WITH ALASKA IN | DUAL MODE PHASES WITH PUERTO RICO IN |
|---|---|---|---|---|
| | ALASKA IN | PUERTO RICO IN | | |
| A | 1.0 | 0 | ±22.5° | -- |
| CW | 1.0 | 1.0 | ±67.5° | ±67.5° |
| CC | 1.0 | 1.0 | ±112.50° | ±112.5° |
| CE | 1.0 | 1.0 | ±157.5° | ±157.5° |
| PR | 0 | 1.0 | -- | ±22.5° |

PHASE RECONFIGURABLE BEAM ANTENNA SYSTEM

This invention relates to reconfigureable, shaped beam antenna systems and more particularly to ones using a dual-mode power divider.

A dual-mode powder divider is a two-input, N-output network that provides a given power distribution at N output ports when a signal is applied to only one of two input ports and which provides the same given power distribution when the signal is applied only to the other of the two input ports. The N output signals so-produced have a given phase progression. In order to realize a lossless network, the phase progression of the N output signals produced in response to the signal applied to one input port should be conjugate to the phase progression of the N output signals produced in response to the signal applied to the other input port. Dual-mode power dividers are utilized extensively in satellite communication shaped beam antenna designs to separate odd and even adjacent communication channels thereby avoiding a requirement for contiguous multiplexing. U.S. Pat. No. 4,223,282 of Chan and U.S. Pat. No. 3,988,705 of Drapac give examples of such power dividers.

Geosynchronous communication satellites may be located within an orbital arc spanning a wide longitudinal range, and it is often desired to provide on board the satellite an antenna system whose beam pattern can be reconfigured, when desired, to achieve a particular ground coverage sought for a broadcast. The antenna system described herein provides a capability for achieving shaped beam pattern reconfiguration by permitting power switching between the elements of a shaped beam reflector antenna feed array, while at the same time permitting adjacent component beams to have a phase suitable for optimum shaped beam pattern formation.

In an antenna system embodying the present invention, N−1 of the N-output ports of a power divider are coupled to N−1 radiators, respectively. The N'th output port is selectively switchable either directly to an N'th radiator to obtain one beam pattern configuration or through a phase shifter to an (N+1)'th radiator to obtain another beam pattern configuration. The arrangement is such that the phase progression among inputs to radiators is the same for both pattern configurations. In the drawing.

Figures 1, 2:
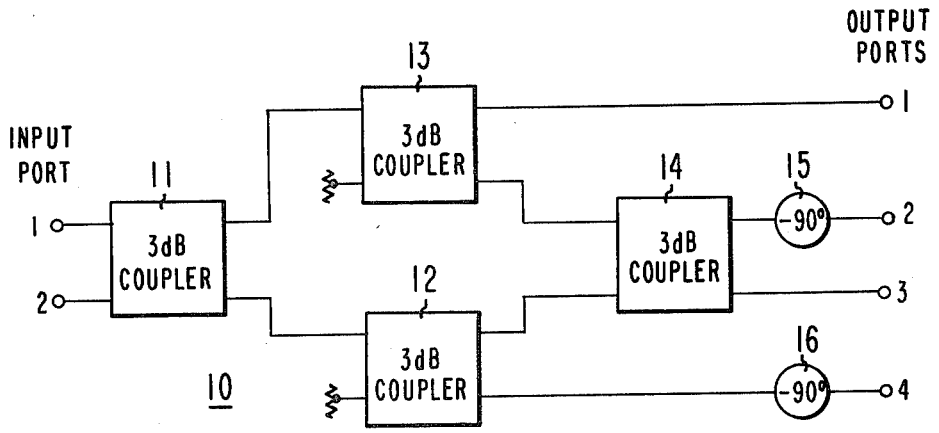
PRIOR ART Fig. 1
FIG. 1 is a block diagram of a prior art 2:4 dual-mode power divider network.
FIG. 2 is a table showing the phases and amplitude distribution for such a network.

A block diagram of a conventional 2:4 Dual-Mode Network (DMN) 10 is shown in FIG. 1. The network includes four 3dB couplers 11, 12, 13 and 14. Each coupler equally divides the input power it receives and provides 90° differential phase shift to the two power divided signals. The input signals at port 1 are equally power divided in coupler 11 and these power divided signals are further equally power divided through couplers 12 and 13 to provide four equally power divided signals. One output from coupler 12 and one output from coupler 13 are each further combined in coupler 14 to produce with the 90° phase shifter 15 and 16 the phase and amplitude distribution as is shown in the Table of FIG. 2. A typical domestic communication satellite in western orbital slot (over the equator but at a longitude at or near that of the west coast of United States) may have this distribution imposed on a four-horn feed array to produce a shaped beam pattern covering CONUS (contiguous United States) and Alaska, utilizing three beams from these ports (output ports 2, 3 and 4 in FIG. 1) for CONUS East (CE), CONUS Central (CC) and CONUS West (CW) coverage, and a fourth (output port 1) for Alaska coverge.

Figures 3, 4:
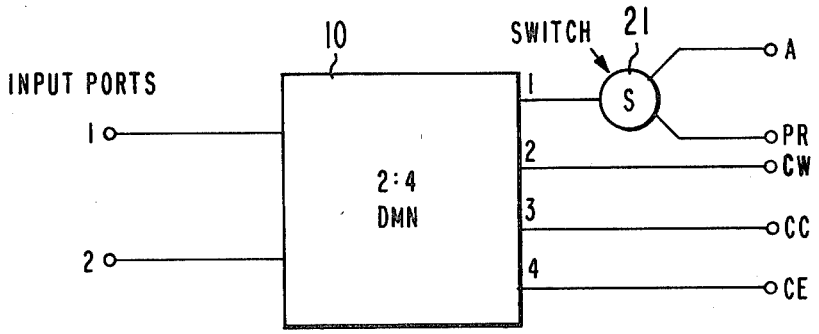
FIG. 3 is a block diagram of the 2:4 power divider of FIG. 1 with one switched output port.
FIG. 4 is a table showing a phase and amplitude distribution for CONUS, Alaska and Puerto Rico.

If this satellite with antenna is relocated to a more eastern orbit position over the equator at a longitude at or near that of the east coast of the United States and Puerto Rico coverage is required, it may be desirable to provide an additional beam for Puerto Rico (PR beam) and switch power to it from the radiating elements for Alaska (A) coverage. If switching is used without phase configuration, as shown in FIG. 3 with switch 21 coupled to output of 2:4 dual-mode network 11, the beam amplitude/phase assignments will be as shown in the Table of FIG. 4 where it can be seen that the CONUS East and Puerto Rico beams have a large relative phase difference, a phase difference of 157.5°−22.5° or 135.5°. This excessive phase difference produces excessive destructive interference in the region between the CONUS East and Puerto Rico beams and produces rapid gain fall off in the eastern region of the shaped beam, placing Puerto Rico and CONUS East Coast coverage in jeopardy. Phasers representing the dual-mode output signals of the conventional 2:4 network are shown by solid lines in FIG. 5.

Figure 5:
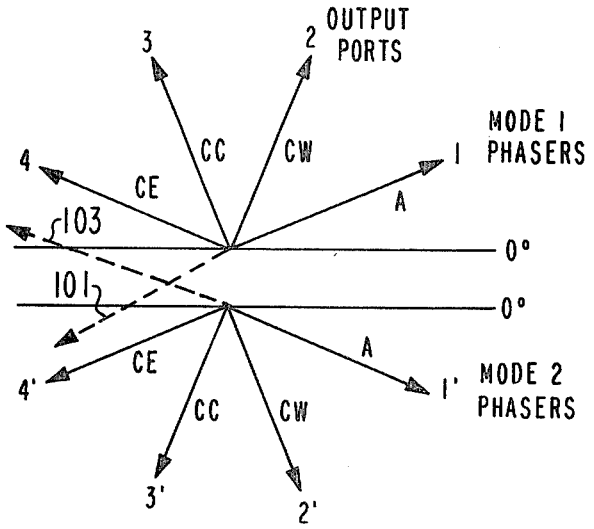
FIG. 5 illustrates in solid lines the phases of the beams for the system of FIG. 3 and in dashed lines the phases of the beams for the system according to a preferred embodiment of the present invention.
Figure 6:
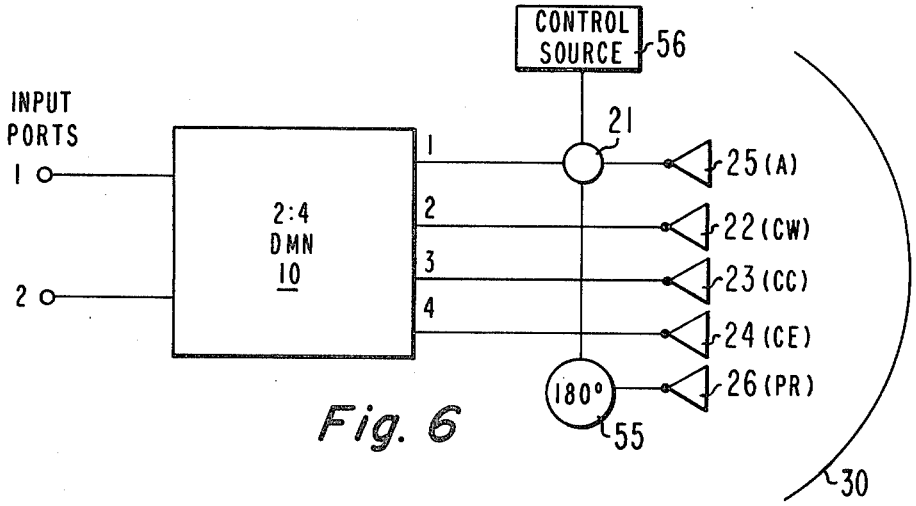
FIG. 6 is a block diagram of the reconfigurable beam antenna system according to a preferred embodiment of the present invention.
Figure 7A:
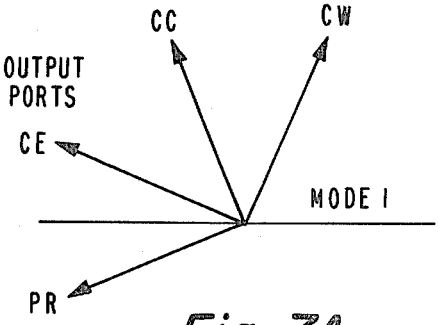
FIGS. 7A and 7B illustrate the phasers for the beams according to FIG. 6 when switched to remove Alaska coverage and provide Puerto Rico coverage.
Figure 7B:
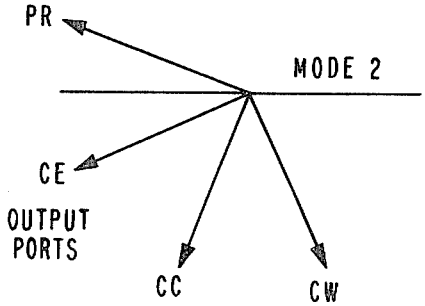

By incorporating a fixed 180° phase shifter in the Puerto Rico beam, at the switched output of the network 10 as shown in FIG. 6, the phasers are altered as indicated by dashed lines 101 and 103 in FIG. 5 to produce the phaser configuration of the beams as shown in FIGS. 7A and 7B for signals at input ports 1 and 2 respectively. The pahse of the signal from output port 1 is then brought into close correspondence with phase of the signal from output port 4, hence beams coupled to these ports will combine constructively in shaped pattern formation.

The reconfigurable antenna system is shown in FIG. 6. The input signals at input port 1 are coupled via 2:4 dual-mode network to output ports 1, 2, 3, and 4 as before. The signals at output ports 2, 3 and 4 are applied to corresponding horns 22, 23 and 24 to provide CONUS coverage. The signals at output port 1 are applied to a switch 21 which is coupled to either horn 25 for Alaska coverage or via a 180° phase shifter 55 to horn 26 for Puerto Rico coverage. When the satellite is providing Alaska coverage, switch 21 is in a position to couple the signals at output port 1 directly to horn 25. When the satellite is moved to hover near the east coast (eastern orbit) a control signal is applied from source 56 to switch 21 to switch the power at output port 1 to horn 26 via 180° phase shifter 55 for Puerto Rico coverage. The control signals to switch 21 to change coupling state may be provided from a ground station via the satellite telemetry system.

The antenna system on the satellite may be like that illustrated in FIG. 6 where output ports 1, 2, 3, and 4 are coupled to in-line horn radiators 25, 22, 23 and 24 and 26. Puerto Rico horn radiator 26 is in line with and adjacent to CE horn 24. The Alaska horn 25 is adjacent and in line with the CW horn 22. These horn radiators are generally located at the focus of parabolic reflector dish 30.

Although the dual mode network described herein equally divides the power to the output ports the system described above can work equally well for unequally power divided signals. Also, the phase progression need not in all cases be linear. What is claimed is:

1. A reconfigurable beam antenna system for selectively providing first and second shaped beams comprising, in combination:

N+1 radiators, where N is an integer;

power divider means having two input ports and N output ports, responsive to an input signal applied to only one of said input ports for providing at said N output ports power divided signals of given relative powers in a first phase progression and responsive to an input signal applied to only the other of said input ports for providing at said N output ports power divided signals of said given relative powers in a conjugate phase progression; and means coupled to said output ports for coupling said N power divided signals to N of said radiators, respectively, said means for coupling including phase shifting means, and switching means responsive to a control signal for switching the power divided signal applied to a particular one of said N radiators to the (N+1)'th of said radiators through said phase shifting means for introducing an appropriate phase shift in the energy applied to said (N+1)'th radiator to maintain the same phase progression in the respective signals being applied to the radiators.

2. The combination of claim 1 wherein said radiators are arranged in row and wherein said switching means is coupled to a radiator located at one end of said row.

3. The combination of claim 2, wherein said phase shift means comprises a 180° phase shifter.

4. The combination of claim 1 wherein said power divider means is a 2:4 dual-mode power divider.

5. A reconfiguration beam antenna system for selectively providing first and second shaped beam patterns comprising, in combination:

five radiators arranged generally in a row;

a power divider network responsive to signals at one input for providing equal power divided signals in first linear phase progression at four output ports and responsive to signals at a second input for providing equal power divided signals in a conjugate linear phase at said four outputs ports;

means for coupling three adjacent center radiating elements to corresponding three output ports of said power divider network and selective switching means for coupling the fourth output terminal of said power divider to selectively first and second opposite end radiating elements, said selective switching means including means for providing fixed additional 180° phase shift to signals at said second of said end radiating elements.

* * * * *

UNITED STATES PATENT AND TRADEMARK OFFICE
CERTIFICATE OF CORRECTION

PATENT NO. : 4,471,361

DATED : September 11, 1984

INVENTOR(S) : Charles E. Profera Jr. et al.

It is certified that error appears in the above-identified patent and that said Letters Patent is hereby corrected as shown below:

Column 1, line 5, "reconfigureable" should be --reconfigurable--.

Column 1, line 8, "powder" should be --power--.

Column 1, line 24, "4,223,282" should be --4,223,283--.

Column 2, line 12, "shifter" should be --shifters--.

Column 2, line 23, "coverge" should be --coverage--.

Signed and Sealed this

*Twenty-sixth* Day of *February 1985*

[SEAL]

*Attest:*

DONALD J. QUIGG

*Attesting Officer* *Acting Commissioner of Patents and Trademarks*